US010504321B2

(12) United States Patent
Burgstaller et al.

(10) Patent No.: US 10,504,321 B2
(45) Date of Patent: Dec. 10, 2019

(54) ROULETTE GAMING SYSTEM

(71) Applicant: Gryphon Invest AG, Zürich (CH)

(72) Inventors: Jürgen Burgstaller, St. Marein-Feistritz (AT); Miha Stegel, Kanal (SI); Silvester Zupancic, Ljubljana (SI); Siniša Jojic, Ljubljana (SI)

(73) Assignee: Novomatic AG, Gumpoldskirchen (AT)

( * ) Notice: Subject to any disclaimer, the term of this patent is extended or adjusted under 35 U.S.C. 154(b) by 223 days.

(21) Appl. No.: 15/424,326

(22) Filed: Feb. 3, 2017

(65) Prior Publication Data

US 2017/0256121 A1 Sep. 7, 2017

(30) Foreign Application Priority Data

Mar. 4, 2016 (EP) ..... 16158784
Mar. 11, 2016 (EP) ..... 16159807

(51) Int. Cl.
*G07F 17/32* (2006.01)

(52) U.S. Cl.
CPC ..... *G07F 17/322* (2013.01); *G07F 17/3288* (2013.01)

(58) Field of Classification Search
CPC ..... G07F 17/322; G07F 17/3258; A63F 2009/0092; A63F 2009/0089; A63F 2009/0087; A63F 7/2409; A63F 5/0005
See application file for complete search history.

(56) References Cited

U.S. PATENT DOCUMENTS 4,337,945 A 7/1982 Levy
4,391,442 A 7/1983 Levy
4,869,505 A 9/1989 Manabe
4,906,005 A 3/1990 Manabe
4,995,374 A * 2/1991 Black ..... A01K 15/025 124/32
6,047,965 A 4/2000 Mollo et al.
(Continued)

FOREIGN PATENT DOCUMENTS

EP 0763374 A1 3/1997
JP H08229191 A 9/1996
JP 2011240045 A 12/2011
(Continued)

OTHER PUBLICATIONS

European Partial Search Report dated Sep. 16, 2016 for European Application No. EP 16159807.3.
(Continued)

*Primary Examiner* — David L Lewis
*Assistant Examiner* — Matthew D Hoel
(74) *Attorney, Agent, or Firm* — EIP US LLP

(57) ABSTRACT

The present disclosure relates to a roulette wheel apparatus, and in particular to a ball launcher for use in a gaming system such as a roulette wheel apparatus and roulette wheel apparatus comprising the ball launcher. According to a first aspect, the ball launcher comprises a pair of launch tubes adapted to be connected to the airflow generator and defining different launching directions, wherein the ball gate for gating the ball into one of the launch tubes includes a ball shuttle adapted to be moveable from a ball-receiving station to each one of said pair of launch tubes to transport the ball from the ball-receiving station to one of said launch tubes.

20 Claims, 6 Drawing Sheets

(56) References Cited

U.S. PATENT DOCUMENTS

| | | | | |
|---|---|---|---|---|
| 2008/0188288 | A1* | 8/2008 | Seelig | G07F 17/3202 463/20 |
| 2010/0124966 | A1 | 5/2010 | Kido | |

FOREIGN PATENT DOCUMENTS

| | | | | |
|---|---|---|---|---|
| WO | WO 2004/094013 | A1 * | 11/2004 | A63F 5/04 |
| WO | 2015/114302 | A1 | 8/2015 | |
| WO | WO 2015/114302 | A1 * | 8/2015 | A63F 5/00 |
| ZA | 9807903 | B | 3/1999 | |

OTHER PUBLICATIONS

European Search Report dated Feb. 17, 2017 for European Application No. EP 16159807.3.

* cited by examiner

ROULETTE GAMING SYSTEM

CROSS-REFERENCE TO RELATED APPLICATIONS

This application claims priority under 35 U.S.C. § 119 to EP Application number EP16158784.5, filed Mar. 4, 2016, and EP Application number EP16159807.3, filed Mar. 11, 2016. Both of the aforementioned applications are incorporated by reference in their entirety.

BACKGROUND OF THE INVENTION

Field of the Invention

The present disclosure generally relates to a ball gaming system such as a roulette wheel apparatus, and in particular to a ball launcher for use in a gaming system such as a roulette wheel apparatus and to a gaming system such as a roulette wheel apparatus comprising the ball launcher.

Description of the Related Technology

It has previously been proposed to provide an automatic roulette wheel assembly comprising a roulette wheel having a number of slot compartments circumferentially arranged. The wheel is rotated by a motor and a ball fire mechanism is arranged to fire/launch a roulette ball onto the rotating wheel so that the ball, after passing a zone having obstacles for diverting/deflecting the ball, will land in one of the slot compartments, which process is being regarded as drawing a random number.

The automatic roulette wheel assembly may comprise a return mechanism to return the ball from the slot in which it lands back to the firing mechanism. Such an automatic roulette wheel assembly may be used to provide a game of roulette operated by a croupier taking bets and paying out winnings in a casino.

It has previously been further proposed to provide a fully automatic roulette wheel assembly by providing such an automatic roulette wheel assembly together with means to identify the slot compartment in which the ball lands, and means for users to place bets and receive any winnings. Such a fully automatic roulette wheel assembly may be used to provide a game of roulette without requiring any human operator, either in a casino or remotely, for example with the game being viewed and bets placed by, and winnings paid to, players via an electronic interface and over the Internet.

Document US 2010/0124966 discloses a roulette game system wherein the ball may be launched by means of applying an accelerating force to the ball by air discharged from discharge openings provided in an edge portion of the gaming area. Starting and stopping the discharge of the pressurized air is controlled by a timer, wherein bet end timing is set through an external operation by staff in a game hall or a controller so as to make sure that it is impossible or at least to add difficulty to predict a location at which the ball falls. More particularly, pressurized air injected into the landings or pockets of the roulette wheel via nozzles associated with said pockets force the ball from the respective pocket radially outwards towards the outer rim of the roulette wheel where additional air nozzles arranged substantially tangential to the outer rim of the roulette playing area discharge pressurized air to force the ball to roll along the bank path at the upper edge of the roulette playing area. Thus, the ball does not leave the playing area and a usual launching unit for launching the ball from outside into the playing area can be dispensed with. To avoid blowing of the ball beyond the outer rim to the outside of the roulette playing area, the upper side of the playing area is closed by a transparent cover having a hemispherical shape.

Document U.S. Pat. No. 4,906,005 discloses a roulette playing device where the ball is launched into the playing area from the outside by means of a ball launch device using pressurized air to convey the ball through a launching tube. To allow for a fully automatic operation of the game, a ball that has landed into one of the pockets of the roulette wheel, may be discharged into a collection funnel below the roulette wheel by means of lowering the roulette wheel to allow the ball to roll from the pocket into said collection funnel from which it may roll into a gating device from where the ball is conveyed by means of pressurized air to a spinning device hitting out the ball back into the playing area. Such spinning device includes a pair of driven rollers having a distance from each other smaller than the ball's diameter so that the ball sent to the spinning device by means of pressurized air is caught in the opening between the two rollers which are then driven at different rotational speeds, thus giving spin to the ball when it is injected into the gaming area.

A similar ball spinning device is disclosed by WO 2015/114302 A1 showing a ball launcher having a pair of driven wheels spaced apart from each other at a distance smaller than the ball's diameter. The driving direction of said pair of wheels can be changed, thus allowing to fire the ball in either of two opposite directions.

Furthermore, U.S. Pat. No. 6,047,965 discloses a roulette gaming device using pressurized air to further randomize the gaming results. More particularly, the so-called canoes forming the obstacles between the outer bank path and the rotating roulette wheel are provided with air nozzles to inject pressurized air onto the playing area in substantially diagonal directions.

SUMMARY

It is a general objective underlying the present disclosure to provide for an improved roulette gaming system avoiding disadvantages of the prior art and achieving improved functionality.

Another more particular objective underlying the present disclosure is to provide for an improved ball game system having an increased security against manipulation and providing for a reliably launching of the ball into the gaming area.

Another particular objective underlying the disclosure is to provide for an improved gaming system that adds difficulty to predict a location where the ball will fall.

Another objective underlying the disclosure is to allow for a quick recovery of a ball discharged from the gaming area after a game and quickly relaunching the ball into the gaming area to avoid lengthy downtimes.

A further objective underlying the disclosure is to provide for a simple but reliable ball launcher for launching the ball in different directions with spin into the playing area of the gaming system.

Finally, it is also desired to increase the level of interest, excitement and volatility associated with playing the game.

According to the present disclosure, such objective is achieved by a ball launcher as defined herein.

More particularly, to achieve at least one of the aforementioned objectives, the present disclosure provides for a ball launcher launching the ball from outside into the playing area into different launching directions by means of pressurized air that can be directed into different directions. According to a first aspect, the ball launcher comprises a pair of launch tubes adapted to be connected to the airflow generator and defining different launching directions, wherein the ball gate for gating (i.e. to channel) the ball into one of the launch tubes includes a ball shuttle adapted to be moveable from a ball-receiving station to each one of said pair of launch tubes to transport the ball from the ball-receiving station to one of said launch tubes. Contrary to a ball rolling and finding its way into the launch tube by itself, the ball shuttle allows for actively moving the ball to the respective launch tube, thus providing for precise launch timing. The ball-receiving station may be positioned between said pair of launch tubes so as to provide for a short shuttle path to both launch tubes, thereby achieving efficient and quick shuttle operation.

The ball launcher may comprise more than two launch tubes which may define more than two different launching directions, wherein three or four or five or even more launch tubes may be serviced by a common ball shuttle which may stop at each of said launching tubes to hand over the ball to be launched through the respective launch tube from outside into the playing area.

According to an embodiment, the ball shuttle may include a shuttle rotor that may be driven to rotate about a shuttle rotor axis so that a ball-receiving seat of said shuttle rotor moves along a circular path around said shuttle rotor axis. The launch tubes may have openings which are positioned spaced apart from each other along said circular path of the ball-receiving seat. Thus, the shuttle rotor may be rotated to bring the ball-receiving seat into registration with one of the launch tubes.

Said shuttle rotor may be rotatory driven by a stepper motor which precisely may rotate the shuttle rotor to stop at desired positions, in particular at the ball-receiving station and each of the transfer stations where the ball is transferred from the shuttle to the respective launch tube. Basically, instead of such stepper motor, other drive means might be provided, for example in combination with mechanical stopping means against which the shuttle can be driven to stop at the desired position. Nevertheless, the aforementioned stepper motor may be advantageous with regard to wear and tear.

Said ball-receiving seat of the ball shuttle may have various shapes and forms, wherein it may be open to one side to receive a ball from a predetermined receiving direction and may include a pair of engagement contours extending transverse to the shuttle-moving path to force the ball from the receiving station to the respective launch tube. Furthermore, the receiving seat may have at least one open side to allow the ball to go into the launch tube. More preferably, the aforementioned ball-receiving seat may be formed by a through hole which may be brought into registration (coincidence, alignment) with the respective launch tube so that pressurized air may be injected into said through hole from one side to force the ball to leave into the launch tube on the other side. In addition or in the alternative, the through hole may have an open radial side and/or a radial opening and/or be formed as a slot-like longitudinal hole open to one longitudinal end to allow for receiving a ball in a direction transverse to the longitudinal axis of the hole.

According to another aspect, the ball shuttle may not only transport the ball from the receiving station to the launch tube, but also may influence the airflow from the airflow generator and the launch tube, thus fulfilling a double function. More particularly, the valve shuttle may form a valve which may at least partly close one of the launch tubes when launching a ball through another launch tube to avoid pressure losses via the non-used launch tube. In particular, the ball shuttle may include, in addition to the ball-receiving seat, a valve portion which is moved to the non-used launch tube to close such launch tube at least partly when the valve seat is moved to the other launch tube.

To combine the valve function with the ball transport function in a space-saving way providing for easy kinematics, the ball shuttle may be formed as a moveable, preferably rotatable valve plate including a through hole forming the ball-receiving seat for receiving the ball, wherein the launch tubes may have endings facing said valve plate at a path along which the through hole is moveable. Thus, the valve plate, when moving transverse to the longitudinal direction of the launch tubes, may close the launch tubes except when the through hole comes into registration with one of the launch tubes.

To allow continuous working of the airflow generator, a discharge valve may be provided for discharging pressurized air during phases when none of the launch tubes is open or used, wherein such discharge valve also may be incorporated into the ball shuttle and in particular into the valve plate formed by such ball shuttle. The valve plate may include a discharge opening that may connect the airflow generator to a discharge opening when the valve plate is in positions where the ball-receiving through hole is not in registration with any one of the launch tubes. Preferably, such discharge opening may be disconnected from the air generator when the valve plate is moved into a position where the ball-receiving through hole comes into registration with one of the launch tubes, thereby avoiding pressure losses via the discharge opening and increasing the airflow efficiency through the launch tube through which the ball is to be launched.

The aforementioned launch tubes may extend from opposite sides of the ball shuttle to define launching directions opposite to each other.

According to another aspect, the ball launcher may include at least one launch tube having a non-circular cross-section that gives spin to the ball when the ball is moved through the launch tube. Such non-circular cross-section may provide for an asymmetrical engagement between the ball and the circumferential wall of the launch tube, thereby causing the ball to spin about a spin axis going through the ball.

The cross-section of the launch tube may be differently contoured. For example, it may have a polygonal cross-section such as a rhomb-shaped or lozenge cross-section. More particularly, the launch tube may have an oval or elliptical cross-section so that the ball may contact opposite sides of such contour at ball surface points lying on the same half of the ball, thereby creating spin of the ball. The ball may contact the oval or elliptic contour at a portion thereof where the radius of curvature is going towards a minimum, wherein the ball's diameter may be larger than the width of such oval or elliptic portion so that the ball is contacted below its horizontal middle plane.

Depending on the desired orientation of the ball spin, the non-circular contour may have different orientations. For example, the non-circular cross-sectional contour of the launch tube may have a main cross-sectional axis extending in an upright direction to give the ball a forward spin wherein such main axis may be the longer one of the two main axes of an oval or elliptical contour. When the ball exits the launch tube with forward spin, it will cause less friction than with counter spin. Therefore, wear and tear and abrasion of the ball material and/or the gaming area surface may be reduced.

In addition to controlling spin of the ball more reliably, a non-circular cross-section of the launch tube may achieve more consistent speed as oscillation of the ball transverse to the longitudinal axis of the launch tube can be avoided. Such oscillation of the ball occurring in a conventional launch tube of a circular cross-sectional shape may result in drastically lower ball exit speed and thus, in an invalid ball shot.

The non-cross-sectional shape of the launch tube may be produced by deformation of a tube initially having a circular cross-section. For instance, a number of u-shaped clips or profiles may be attached to the outside of the launch tube to produce such oval or elliptical tube shape in very simple manner. The width of the u-shaped clips may define the non-circular cross-sectional shape of such constrained launch tube.

Due to such non-circular shape of the launch tube, no separate spinning devices (to give the ball a spin) are necessary, such as rotatably-driven wheels spaced apart from each other and defining a gap through which the ball is forced by rotation of said wheels. Nevertheless, such separate spinning device may be used in addition.

In order to achieve a simple design and construction, the ball launcher may dispense with such separate spinning devices and the launch tube may provide for a continuous, obstacle-free non-stop path for the entire way of the ball from the ball gate and the ball shuttle, respectively, to the playing area of the gaming system and the entrance thereof.

In order to achieve a quick recovery of a ball leaving the playing area after a playing round has been finished according to another aspect, the ball launcher may have a feeding tube for feeding a ball from the playing area to the ball gate, said feeding tube having an inlet to be associated with a discharge opening of the playing area, wherein said feeding tube may define a substantially vertical ball path from the playing area's discharge opening to the ball gate of the ball launcher to allow the ball to directly fall from the playing area into the ball gate of the ball launcher.

In other words, the ball may be dropped directly from the playing area to the shootout position in almost vertical path. By this measure, the ball is moved in a comparatively fast way from a point/position where it is visible to the player to the point/position where the ball is ready to shootout without any additional mechanism or pushing of the ball. This approach allows for a single ball gaming, in particular roulette system (i.e. only one ball is in the system) to keep the single ball on the playing area until just moments before the shootout, hence further enhancing trust into the roulette gaming system.

Discharging the ball from the playing field after a gaming round has been finished, may be achieved in different ways. For example, when the gaming system is a roulette gaming system comprising a rotatable roulette wheel having a plurality of ball-receiving pockets and located in a wheel bowl, said pockets of the roulette wheel may have no bottoms and a ball-supporting surface may be provided underneath the roulette wheel. When the ball has landed in one of the pockets, the roulette wheel may be rotated to a predetermined position and/or the supporting surface underneath the roulette wheel may be moved and/or configured to provide an opening at such predetermined position where the pocket with the ball has been rotated to. More generally, the ball-supporting surface underneath the roulette wheel may include a moveable member coplanar with the surrounding supporting surface and arranged for selective movement between a first position where the moveable member will support the ball located in the pocket and a second position where the moveable member will not support the ball located in the pocket.

Another option for discharging the ball from the playing field is adjustment of a center piece of the roulette wheel in height. More particularly, an inner portion of the roulette wheel adjacent to the pocket ring and forming an inner barrier preventing the ball lying in one of the pockets from rolling out of the pocket, may be elevated so that the pockets get rid of the aforementioned inner barrier and a ball received in one of the pockets may roll down and drop into the inlet of the feeding tube to fall down to the shootout position. Before said inner portion of the roulette wheel is elevated, the roulette wheel has been rotated to the predetermined position where the respective pocket in which a ball has landed is positioned above the inlet of the feeding tube of the ball launcher, as described before.

In the alternative, the pockets themselves may be provided with a bottom that can be opened, for example in terms of a flap or trap door to discharge the ball from the spinning wheel to the ball launcher which may be positioned immediately beneath the spinning wheel.

The gaming system may include a sensor device for determining the pocket in which a ball landed so that a roulette wheel controller may rotate the roulette wheel to register the determined pocket with the discharge station and the ball launcher's feeding tube inlet.

According to a preferred embodiment, a high resolution encoder for determining the position of the roulette wheel comprising the (numbered) compartments may be provided. The high resolution encoder may provide more signals per revolution of the wheel than the number of pockets is, and allows for higher precision which helps with smoother spinning at lower speeds, smoother PID regulation, stopping of the wheel at exact position.

In a preferred embodiment the encoder(s) has a resolution of more than 38 steps taking into account the usual number of pockets of a roulette wheel. By such measures accurate stopping and positioning of the wheel for the direct drop is possible, and it provides less stress for mechanical components and more reliable operation of the roulette wheel.

According to another aspect, the airflow generator may be adapted to provide for variable airflow mass and/or variable airflow speed and/or variable airflow pressure, wherein said airflow generator may be controlled by an airflow controller in response to ball speed detected by at least one ball speed detection device in said at least one launch tube or in said playing area. Such variable control of the airflow may be used to vary the ball speed to further randomize the gaming results. It also may be used for compensation of wear and tear of the airflow generator or contamination and pollution of the airflow generator and its attachments such as an air filter getting clogged.

The aforementioned ball speed detection device may include speed sensors directly measuring ball speed, for example radar sensing devices. In the alternative or in addition, the ball speed detection device may include at least two ball sensors spaced apart from each other along the ball path through the launch tube and/or in the playing area, such ball sensors giving ball detection signals at different points of time corresponding to the distance of the ball sensors and the ball speed. As the distance of the ball sensors is known, a speed calculator may calculate ball speed from the time difference between signals of said ball sensors.

Such at least two sensors or other elements of the speed detection device such as the aforementioned radar sensor may be positioned at the exit of the launch tube and/or the entrance of the ball into the playing area and/or in the vicinities thereof so as to detect or determine the speed of the ball entering into the gaming area. In addition or in the alternative, the speed detection device may be positioned or may include sensors positioned at other sections of the launch tube and/or at other sections of the gaming area such as the outer rim defining the bank path of a roulette gaming device.

In response to the determined speed of the launched ball, a variety of parameters may be adjusted, for example airflow, air pressure, air flow direction, timing of the injection of air, rotational speed of a blower creating the airflow and/or position or operational status of a valve device that may influence airflow. For example, airflow and/or air pressure during the launch process, i.e. when the ball goes through the launch tube, can be adjusted to achieve a desired ball speed. In the alternative or in addition, airflow and/or air pressure and/or timing thereof may be adjusted after the ball has entered into the playing area. For example, the launch tubes may be used to inject air onto the outer portion of the playing area of a roulette game so that such injected air may influence spinning and/or speed of the ball rolling along the bank path of the roulette bowl. For example, when injection of air is continued through the launch tube through which the ball was launched, speed of the ball may be increased or at least maintained as the injected air goes along the bank path in the same direction as the ball rolls and thus, the injected air may push the ball from behind. On the other hand, if a launch tube going into the opposite direction (in comparison to the launch tube through which the ball was launched) is used to inject air, the ball rolling along the bank path may be decelerated and/or given a counter spin.

So as to influence ball speed and/or spinning thereof after the ball has been launched onto the playing area, air may not only be injected through the aforementioned launch tubes, but through additional air injection tubes which may not be used for ball launching. For example, additional air injection tubes may end in the vicinity of the bank path and/or via the canoes forming obstacles in the upper portion of the roulette wheel.

Thus, after successful launch of the ball additional air may be injected through any existing holes and/or the launch tubes. Throughout the game any of the tubes might be used irrespectively of the launch direction to influence the airflow in the playing area.

If the speed of the ball when it enters the playing area is below minimal required speed, system can use airflow in the direction of the ball to salvage the game, thus, reducing the number of invalid shots. Same technique can be used to enforce minimal number of circles.

Airflow in the direction of the ball spinning can be achieved by injecting air through the tube that launched the ball.

Airflow in the opposite direction of the ball spinning can be achieved by injecting air through a tube which did not launch the ball.

Similar effects can be achieved with air suction. Air suction is, however, not as efficient as air injection.

Thus, ball speed may be controlled by means of adjusting the strength of the airflow and/or the airflow direction. In particular, so as to decrease speed of a ball, airflow may be reversed and/or airflow in the direction opposite to the ball moving direction may be injected. On the other hand, so as to increase ball speed, airflow going the same direction as the ball moving direction may be increased or additionally injected.

Airflow changes also may be achieved by pivoting/swiveling/moving the ball shuttle from an exhaust position to any of the launch tubes positions or from any of the launch tubes positions to exhaust position or portions in between.

Adjustments of the air throughput by only partially opening the desired holes (i.e. launch tubes or exhaust) is possible by adequate control of the position of the ball shuttle or the valve plate thereof, in particular control of the angular position of the shuttle rotor. In other words, the shuttle rotor positions allow airflow with all airflow to the first or second launch tube or all flow to the exhaust or there may be various degrees of partially opened exhaust and one of the first or second launch tubes in between.

The blower of the airflow generated for instance may be a mechanical component that has certain momentum and needs some time to develop the full power. In a preferred embodiment a separate exhaust allows prestart of the blower while the ball is waiting (until shoot out signal) or is still entering the ball shooter hence preparation time until the next game is reduced.

By such measures faster ball launch, faster airflow adjustments, reverse airflow, reduced costs, higher availability and shorter game cycles, may be achieved.

More than one sensor may be used to detect the ball on the exit of the launch tube.

Multiple sensors at the exit of a launch tube may be provided for measuring of the ball speed just before leaving the launch tube. This allows detection of bad shots before the ball is visible on the roulette wheel. The system can then determine if the shot is void and in case of immediately declare invalid game.

The speed of the ball at the exit of the launch tube may also be used to calculate the properties of the system.

Measuring the ball speed at the exit of the launch tube is a significant improvement over measuring the time needed for the ball launch (time from beginning to end of launch path) since the ball oscillation or other launch problem may happen anywhere on the launch path (e.g. if it happens at the end, the time is still acceptable while the speed is well below the target). The measured ball speed more precisely describes the status of the ball. Therefore, two sensors may be positioned close to each other in the vicinity of or at the launch tube exit.

Using two or more sensors also gives the system capability to fall back to basic operation in case of one sensor malfunction.

Ball speed may be measured based on time events of appropriate sensors detecting passing by of the ball. Photo sensors may be provided for detecting the ball and providing the time events. The sensors may be arranged at appropriate distance between each other along the ball path.

Once the ball is launched to the roulette cylinder, at least one sensor, preferably more than one sensor, is used to detect the ball on the rim of the cylinder. Multiple sensors on the rim allow multiple measurements per one spin (i.e. where the ball travels on the rim for one circle) which are then used to better evaluate the acceleration/deceleration of the ball. Using two or more sensors also gives the system the capability to fall back to basic operation in case of one sensor malfunction.

According to a further preferred embodiment, time measurements during the ball launch and/or during spinning of the ball in the cylinder may be performed and results of which may be provided to adjust the power of the blower if needed. The time measurements may be used to regulate blower power based on expected and actual times. Also mechanical malfunctions (like damaged path and bad/invalid ball shots) may thus be discovered.

The time measurements may be collected during the game or with specially triggered calibration shots. Since the measurements may be done during the actual game without influencing the result there is no downtime and that increases the availability of the machine. Adjustments of the blower power may be already used for the next shoot without any downtime or intervention from service personnel.

Pre-failure warnings can be issued when adjusted blower power is nearing the max power (e.g. dirty air filter or mechanical wearing).

In other words, ball triggered time measurement may be used to automatically recommend (e.g. in maintenance mode/administration) or adjust blower settings. The recommendations and auto adjustments significantly simplify the maintenance of the machine. This provides for easier use, less maintenance, increased availability, longer operation in the optimal performance range, pre-failure warnings, reduced cost of ownership, longer lifetime of the product.

In a preferred embodiment full auto calibration may be done on demand, at initial startup or in case if quick auto calibration failed. Full calibration cycle may comprise a series of many individual ball shoots. Quick auto calibration/verification may be done on each startup of a server controlling the roulette system. Quick calibration may comprise only few individual ball shoots to verify if the last values are still valid. If the verification fails a full calibration may be started.

According to a preferred embodiment the cylinder is covered in a way that it closes the air within the cylinder and creates a kind of air chamber which prevents air to escape in unpredictable ways. Such a cover may be in the form of a lid, preferably minimizing airflow in direction normal to the roulette wheel plane. The air chamber does not need to be air tight. Air chamber in combination with air injection forces the air to start flowing in the circular way, increasing and prolonging the effect of airflow control.

BRIEF DESCRIPTION OF THE DRAWINGS

In the following, the present disclosure is described in further detail on the basis of preferred embodiments in connection with corresponding drawings. In the drawings show.

DETAILED DESCRIPTION OF CERTAIN INVENTIVE EMBODIMENTS

Figure 1:
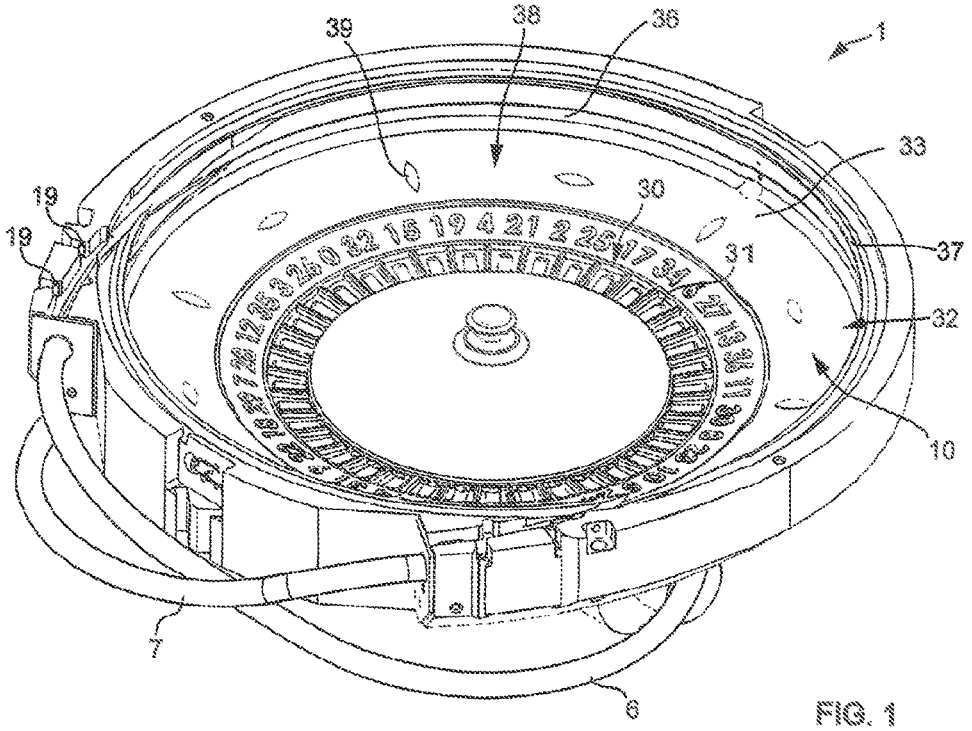
FIG. 1: a schematic view of a roulette gaming system comprising a ball in which a rotatable roulette wheel is provided, wherein two ball launch tubes for launching the ball into the bowl into opposite directions are shown.

As can be seen from FIGS. 1 to 4, a ball game device 1 may be adapted to play the game of roulette. A gaming area 10 of the ball game device 1 may include a spinning wheel 30 which may be provided with a ring of pockets 31 or landings in which a ball launched into the gaming area 10 may stop. As well-known from roulette games, such pockets 31 or landings may be associated with numbers so that the number of the pocket 31 where the ball stops is the winning number.

The spinning wheel 30 is received in a bowl 32 having a rolling area 33 (cylinder) in which a ball 4 rolls in a random number determination phase and a support rack (not illustrated) that supports the bowl 32 of the roulette game device. The spinning wheel 30 and the surrounding rolling area 33 together form the roulette wheel 38 which is the playing area 10. Preferably the roulette wheel 38 is placed horizontally, where the roulette wheel axis is plumb.

The roulette wheel 38 includes a frame body that is fixed at the support rack, wherein said spinning wheel 30 is rotatably held and supported, by one or more bearings, inside a frame body. The spinning wheel 30 may be caused to rotate in a predetermined direction with respect to the frame body (for example, in a clockwise direction) and at a predetermined speed by a drive motor (not illustrated) provided inside the roulette device. The drive motor, and where present, a drive mechanism or transmission, operate under the control of a control system 35 to rotate the spinning wheel 30 in a selected direction at a selected speed.

The rolling area 33 where the ball 4 actually rolls on the roulette wheel may comprise a single inclined face with a predetermined angle (for example, 15 degrees) formed by a first inclined face that is formed at an outer circumferential edge side of the frame body. The inclined face is inclined upward along the direction from the center to the circumference of the roulette wheel 38.

A bank path 36 is provided at an outer circumferential edge portion of the bowl 32. A first launch tube 6 is arranged to let the ball 4 launch to the bank path 36 in a first launch direction. A second launch tube 7 is arranged to let the ball 4 launch to the bank path 36 in a second launch direction, opposite to the first launch direction. The bank path 36 guides the ball 4 against centrifugal force of the ball 4 rolling on the roulette wheel 38 and is a path that causes the ball 4 to roll so as to follow a circular track. In addition, the bank path 36 is formed in an endless fashion with respect to the roulette wheel 38 by way of a guiding wall 37 which is installed upright in a vertical direction. An upper wall portion may be formed to be continuous with the bank path at an upper edge, which is an outer circumferential portion thereof. The upper wall portion is a member that biases the ball revolving on the bank path inwardly so as not to jump to the outside of the roulette wheel.

As the revolution speed of the ball 4 that has been injected to the bank path 36 decreases gradually and loses centrifugal force, the ball 4 rolls and falls along the inclination of the inclined face toward the inside of the roulette wheel 38 and reaches the spinning wheel 30, which is rotating. Then, the ball 4 falls in any one of the pockets 31 that is formed on the wheel. Thus, a winning number is determined by the roulette device. A number of obstacles or canoes 39 (e.g., with rhombus-shaped base) may be provided and arranged on the inclined face to form barriers on which the ball 4 is deflected in random directions by collision, further enhancing the randomness.

The period between the roulette ball being launched into the bank path 36 (ball travels around the upper outer edge of the inwardly sloping rolling area) and the roulette ball beginning its descent towards the wheel is commonly referred to as the spin cycle. The point when the roulette ball begins its descent towards the wheel is commonly referred to as the drop.

The ball game device may be provided with a launching mechanism or ball launcher 3 for launching the ball semi-automatically from outside into the gaming area.

A ball position sensor may be provided to determine the position of the ball 4 in a pocket of the spinning wheel 30, and to provide signals identifying this position to the control system 35. The control system 35 uses these position signals to determine when the ball 4 has come to rest and to identify which one of the landings 31 the ball 4 has come to rest and been retained in. As is well known, in the game of roulette players place various bets which are based on which of the slot compartments the roulette ball is finally retained in, i.e., which random number has been determined by the random process of ball spin and drop.

Then, after the pocket 31 in which the ball 4 is retained has been determined, a ball recovery mechanism operates under the control of a control system to remove the ball 4 from the pocket and return it to the ball launching mechanism so that it can be launched again in a later game of roulette.

Figure 2:
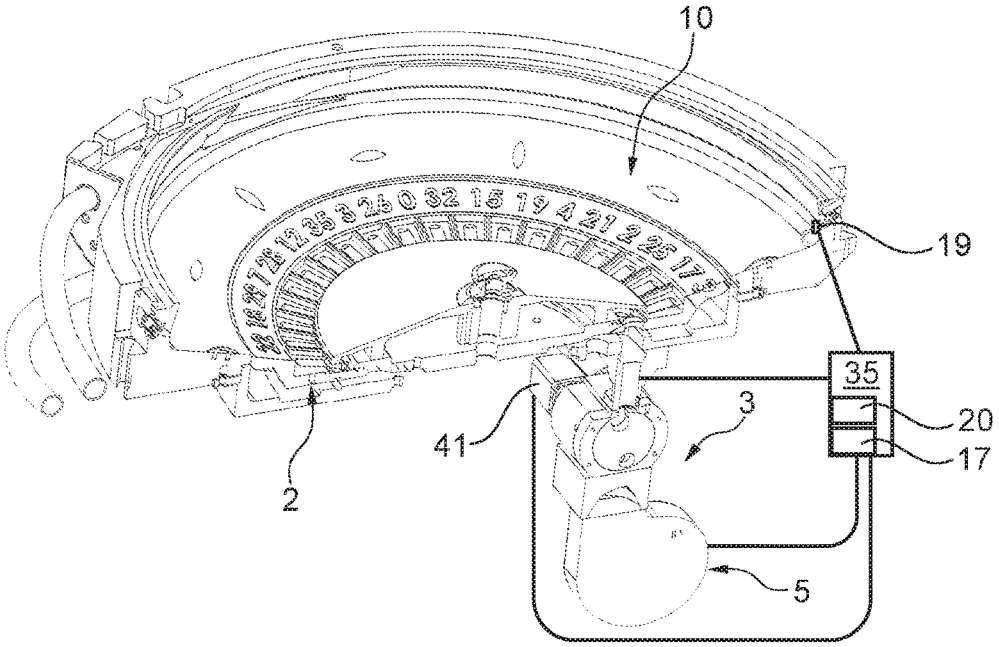
FIG. 2: a perspective, partially cross-sectional view of the roulette gaming system of FIG. 1, wherein the ball launcher positioned beneath the roulette wheel is shown.
Figure 3:
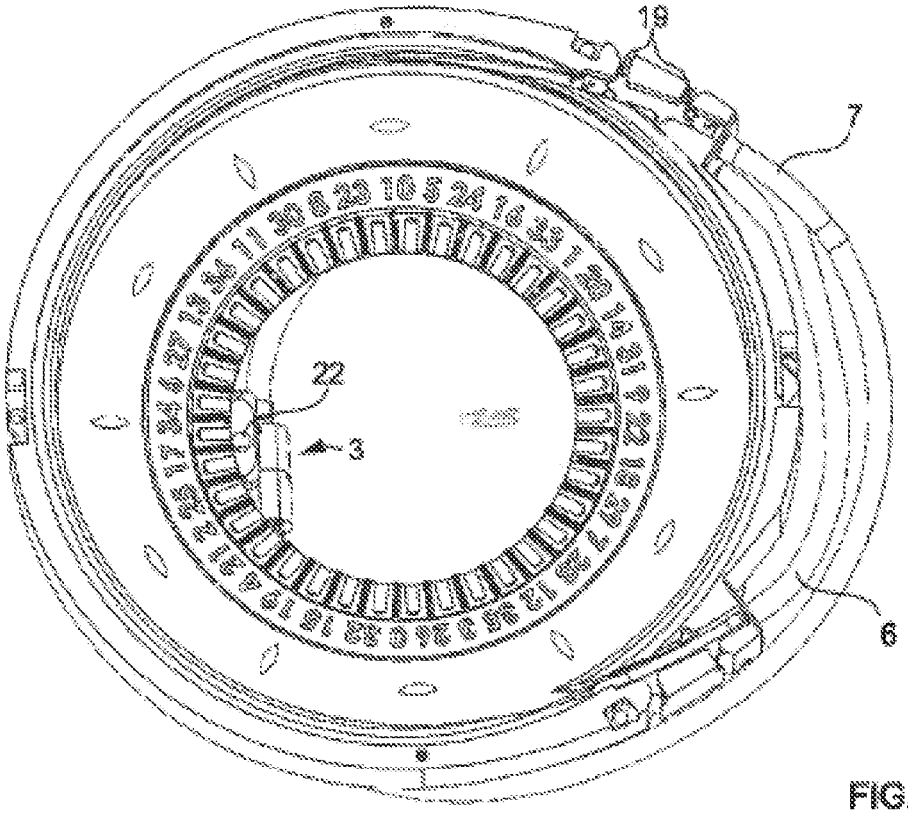
FIG. 3: a top view onto the roulette gaming system of FIGS. 1 and 2, FIG. 4: a perspective view onto the roulette gaming system similar to FIG. 1, wherein the center of the roulette wheel is shown transparent to allow a view onto the ball launcher beneath the roulette wheel and the positioning thereof.
Figure 4:
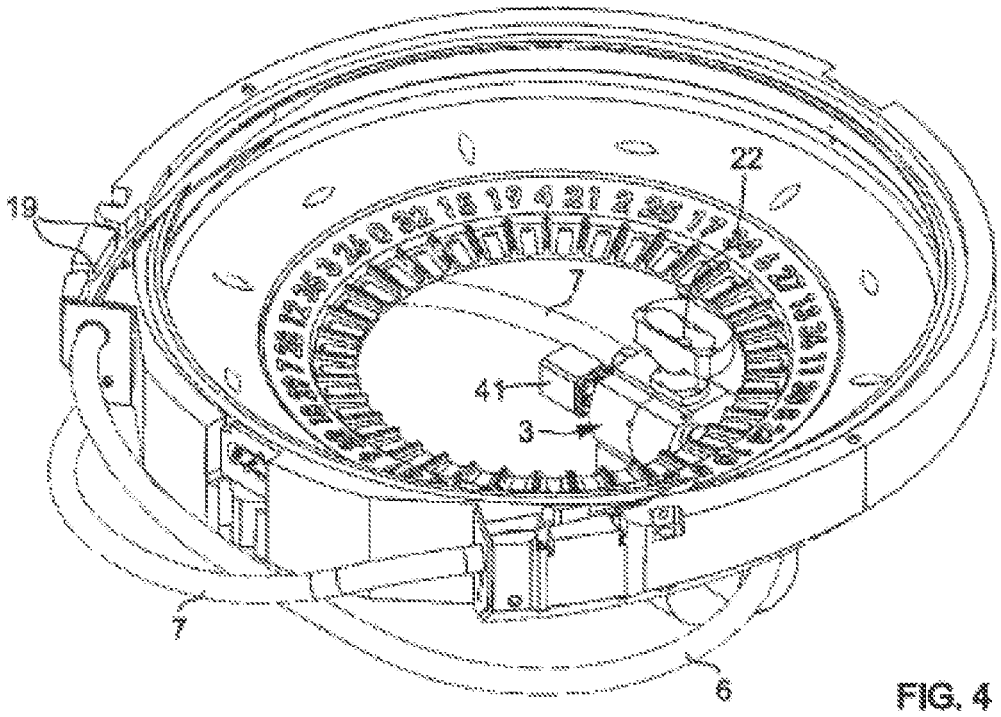

As can be seen particularly from FIGS. 2 and 4, the ball launcher 3 may be positioned directly beneath the spinning wheel 30 to receive the ball 4 discharged from the respective pocket 31. The pocket 31 in which the ball 4 has landed, may be identified by means of a respective detection device which may include ball sensors associated with the pockets 31. In response to the identification of the pockets 31, the spinning wheel 30 may be rotated under control of the control system to bring the pocket 31 into which the ball 4 has landed into registration with the ball launcher, more particularly into a position directly above the ball launcher 3. More particularly, the ball launcher 3 may include a feeding tube 21 which substantially extends vertically (parallel to the axis of the roulette wheel 38) and has an inlet 22 formed by the upper end of said feeding tube 21 positioned directly beneath the spinning wheel 30. The feeding tube inlet 22 may have an increased diameter and/or a sort of enlarged collar to allow for some impreciseness of the position of the pocket from which the ball 4 should be discharged, relative to the feeding tube 21. To discharge the ball 4 from the pocket 31 into the feeding tube 21, an inner portion 40 of the roulette wheel 38 may be elevated so that the ball 4 may roll out of the pocket 31. Adjusting said inner portion 40 of the roulette wheel 38 in height may open the inner side of the pockets 31 and thus, a ball discharge opening 23 of gaming area 10.

Figure 5:
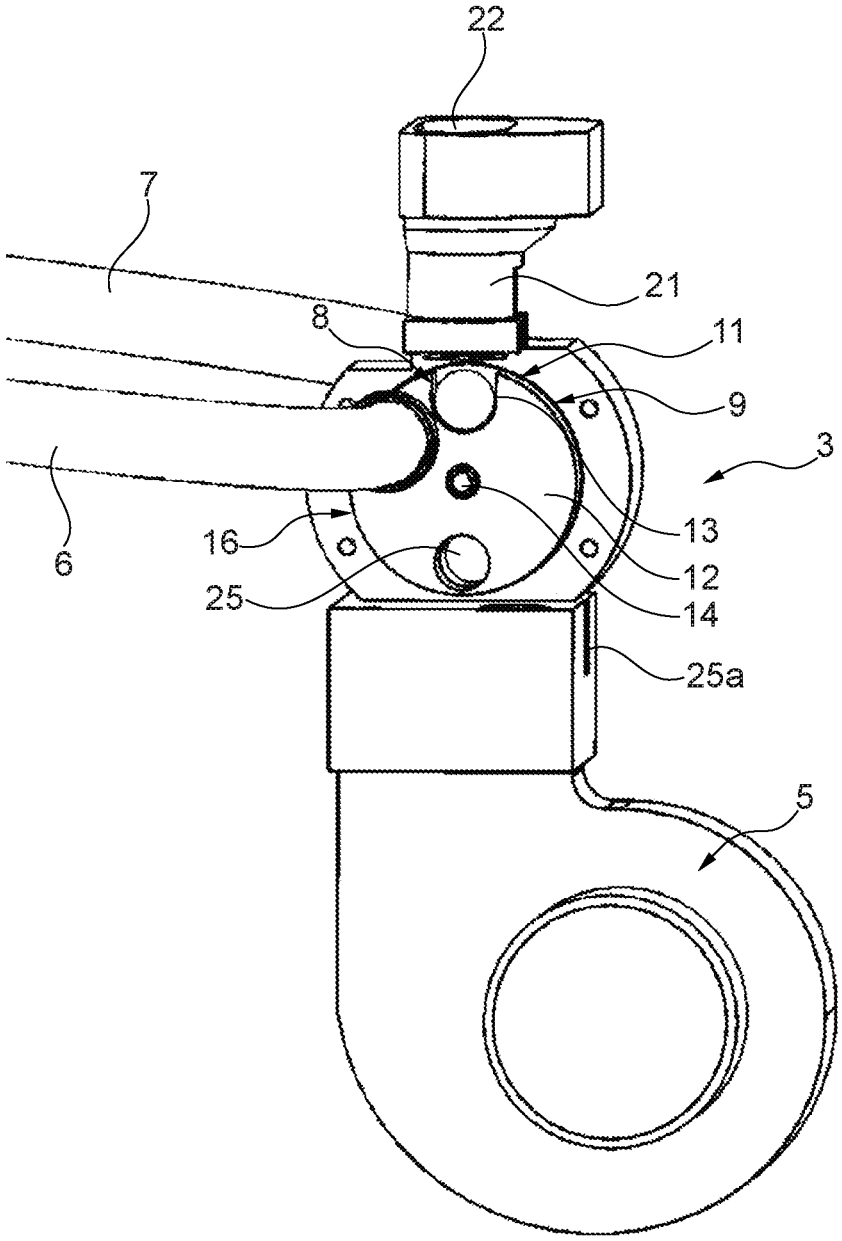
FIG. 5: a schematic side view of the ball launcher of the gaming system, wherein the blower and the combined ball gate and valve shuttle with the launch tubes connected thereto are shown.
Figure 6:
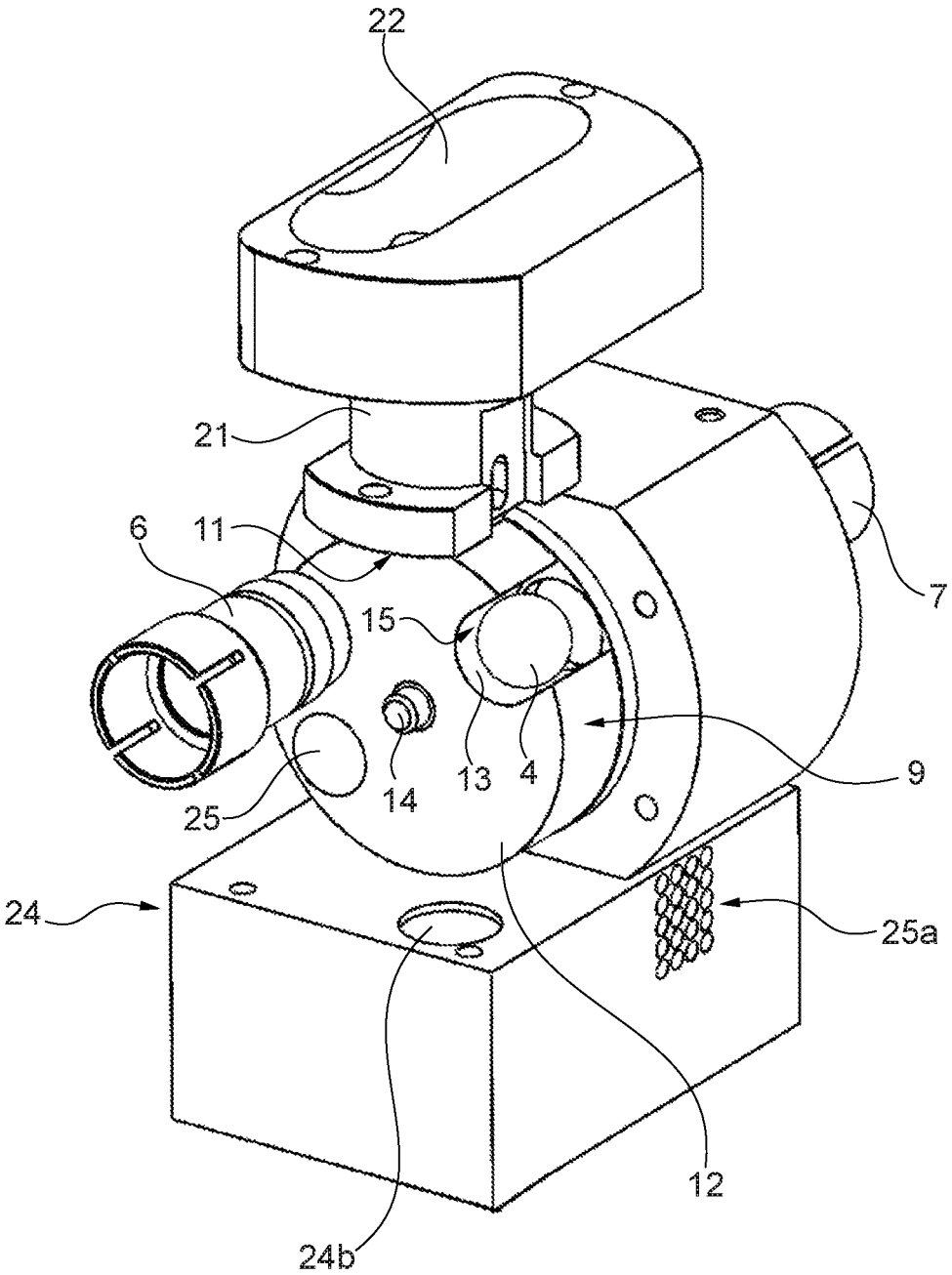
FIG. 6: a schematic, perspective view of the ball launcher of FIG. 5, wherein one half of the ball gate a way valve housing is cut away to show the valve's rotor plate which is shown in a position where the ball-receiving seat is registered with one of the launch tubes.
Figure 7:
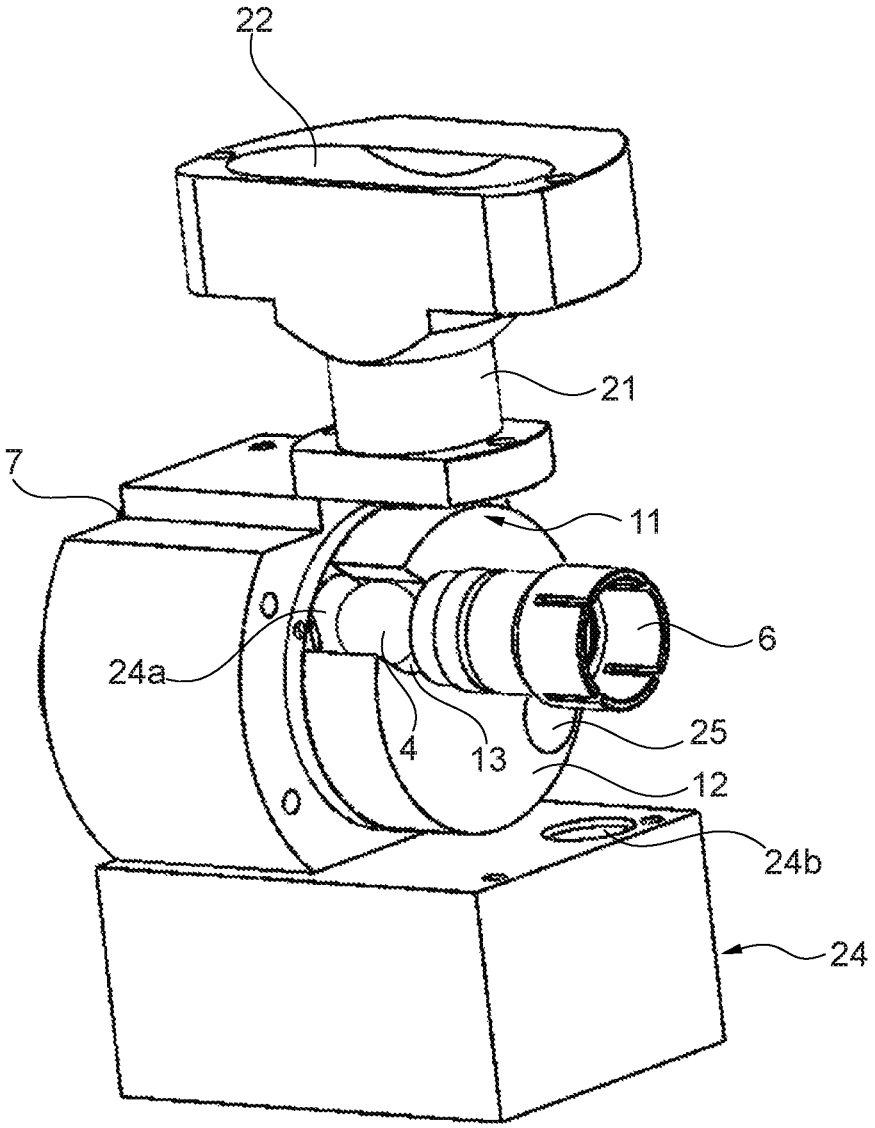
FIG. 7: a perspective view of the ball launcher similar to FIG. 6, where the valve's rotor plate is shown in another rotatory position where the ball-receiving seat is registered with the other launch tube.
Figure 8:
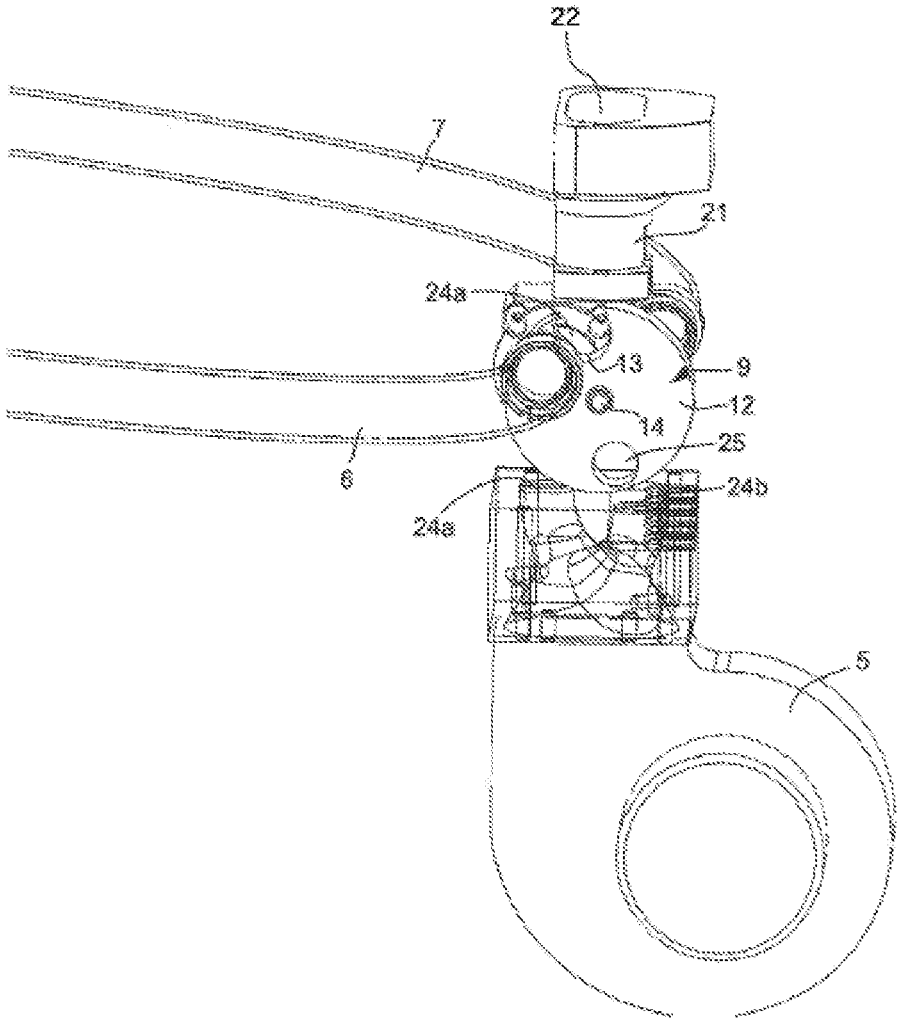
FIG. 8: a schematic perspective view of the ball launcher of FIGS. 1 to 7, wherein the valve's rotor plate is shown in a further rotatory position where the ball-receiving seat is in between the two launch tubes.

As can be seen from FIGS. 5 to 7, the lower end of said vertical feeding tube 21 may lead to and/or may be controlled by a ball gate 8. More particularly, the lower end of said vertical feeding tube 21 is associated with a ball shuttle 9 which has a ball-receiving seat 13 to receive the vertically dropping ball coming from the roulette wheel 38 through the feeding tube 21, cf. FIG. 5 showing the ball shuttle 9 with its ball-receiving seat 13 being positioned at the ball-receiving station 11 where the ball coming from feeding tube 21 may drop into said ball-receiving seat 13.

The ball-receiving seat 13 may be formed by a cavity in the body of said ball shuttle 9, wherein such cavity may be formed as a through hole 15 having an additional open side to the outer periphery of the body of the ball shuttle 9.

More particularly, said ball shuttle 9 may be formed as a shuttle rotor 12 that can be rotatory driven by a shuttle motor 41, which can be a stepper motor. More particularly, the shuttle rotor 12 may be formed as a shuttle plate 16 which may be received within a ball launcher housing and/or rotatably supported on a structural part of the ball launcher 3 about a substantially horizontal axis. It nevertheless should be mentioned that the shuttle rotor axis 14 about which the shuttle rotor may pivot may also extend vertically or at inclinations between vertical and horizontal. However, the shown horizontal shuttle rotor axis 14 is advantageous for launching the ball into opposite directions from said shuttle rotor 12.

The aforementioned ball-receiving seat 13 may be formed by a slot-like recess open to the circumferential side of the shuttle plate 16 and also forming a through hole, i.e. open to opposite main surfaces of the shuttle plate 16. The opening to the circumferential side allows for receiving the ball 4 from above through the feeding tube 21 when the shuttle rotor 12 is in the ball-receiving position where the aforementioned recess is positioned at about 12 o'clock below the feeding tube 21. The through hole openings to the main surfaces of the shuttle rotor plate 16 allow for launching the ball for into either one of the launch tubes 6, 7 leading away from opposite sides of the shuttle rotor 12.

As can be seen from FIGS. 5 to 7, said launch tubes 6, 7 include endings which are positioned at a circle around the shuttle rotor axis 14, wherein such circle corresponds to the circular path of the ball-receiving seat 13 when the shuttle rotor 12 is rotated respectively rotationally placed in certain position. Advantageously, the launch tubes 6, 7 are positioned/arranged on opposite sides of the shuttle rotor 12 at different sectors thereof with the feeding tube 21 or the ball-receiving station 11 being positioned therebetween. For example, the ball-receiving station 11 can be positioned at about 12 o'clock, whereas the first launch tube 6 (i.e. the end of the launch tube into which the ball is blown) may be positioned somewhere between a nine (9) and eleven (11) o'clock position and the second launch tube 7 may be positioned between a one (1) o'clock and three (3) o'clock position. Thus, the rotatory distance from the ball-receiving station 11 to the chosen launch tube 6 or 7 is very short, for instance less than a quarter turn of the shuttle rotor 12, and a fast launching process can be achieved.

As further shown by FIGS. 5 to 8, the ball launcher 3 further includes an airflow generator 5 which may include a blower that can be driven by a blower motor (not shown) which may operate under control of the control system 35.

The airflow generator 5 may produce airflow that is preferably directed to respectively through a forked airflow channel 24, a respective channel 24*a*, 24*b* leading to a respective one of the launch tubes 6 and 7. However, it also would be possible to provide for two separate airflow generators 5 or separate blowers to produce separate airflows for the respective launch tubes 6 and 7.

As can be seen from FIG. 6 and FIG. 7, the aforementioned airflow channels 24 connecting the airflow generator 5 to the launch tubes 6, 7 extend on the opposite side of the ball shuttle 9 and end on the opposite side of said ball shuttle 9 so that airflow exiting the respective airflow channels 24 go through the ball shuttle 9 before entering into the launch tubes 6 and 7. In other words, the ball shuttle 9 is positioned in between the respective ends of the airflow channels 24*a*, 24*b* and the respective ends of the launch tubes 6, 7. The respective end of the launch tubes 6 and 7 is preferably coaxially positioned with the end portion of the respective airflow channel 24*a*, 24*b* so that airflow coming from the respective airflow channel 24*a*, 24*b* may go directly and straightly into the respective launch tube 6 or 7.

The aforementioned shuttle rotor 12 may form a valve plate or control device for controlling the airflow through the launch tubes 6 and 7. More particularly, the shuttle rotor 12 may control the flow connection between the airflow channels 24 and the launch tubes 6 and 7, wherein more particularly the flow connection depends on the rotatory position of the through hole 15 forming the ball-receiving seat 13. When the shuttle rotor 12 is in its ball-receiving position, cf. FIG. 5, both launch tubes 6 and 7 may be disconnected from the airflow as the non-perforated portion of the shuttle plate 16 may block airflow coming from the airflow generator 5 via the airflow channels 24*a*, 24*b* from entering into the launch tubes 6 and 7. So as to nevertheless allow continuous operation of the airflow generator 5, the shuttle rotor 12 may be provided with a discharge opening 25 which may be in connection with the airflow channels 24 when the shuttle rotor 12 is in a non-launching position, such as the receiving-position shown in FIG. 5, and which is connected to an exhaust 25*a* through which the air can be discharged to the environment.

In order to launch a ball through one of the launch tubes 6 or 7, the shuttle rotor 12 is rotated clockwise or counter-clockwise to bring the ball-receiving seat 13 into registration with one of the launch tubes 6 or 7, as it is shown in FIGS. 6 and 7. In particular FIG. 6 shows the position where the ball-receiving seat 13 has been brought in registration with the second launch tube 7 and the airflow channel 24*b*, which airflow channel 24*b* however is not visible entirely since the valve housing is cut away to show the valve's rotor plate.

FIG. 7 shows the position where the ball-receiving seat 13 has been brought in registration with the first launch tube 6 and airflow channel 24*a*.

Bringing the ball-receiving seat 13 into registration with one of the launch tubes 6 or 7 may, at the same time, open the flow connection between the airflow channels 24 to the respective launch tubes 6 or 7, as airflow may go through hole 15.

When reaching such one of the launching positions, i.e. the ball-receiving seat 13 into registration with one of the launch tubes 6, 7, preferably the aforementioned discharge opening 25 may be disconnected from the airflow channels 24 so that the entire airflow goes into the respective launch tube 6,7 and thus, launching becomes very effective.

When a ball 4 is launched through one of the launch tubes 6, 7—which may have an oval or elliptical cross-section as described in more detail above—, a speed detection device 18 may detect ball speed, preferably at the end portion and/or exit of the launch tubes 6 and 7 and/or along the bank path 36 of the roulette bowl. The ball speed detection device 18 may include a plurality of ball sensors 19 positioned preferably in the vicinity of the respective exits of the launch tubes 6, 7 and/or in the launch tubes and/or along the aforementioned bank path 36, wherein the speed sensors may be spaced apart from each other at predetermined distances so that a speed calculator 20 may calculate ball speed from the time difference of the sensor signals. Such speed calculator 20 may be part of the control system 35 to which the ball sensors 19 are connected in a communicative way.

In response to determined ball speed, the control system 35 may adjust airflow, for example by means of adjusting current and/or voltage supply to the blower motor and/or adjusting the position of the ball shuttle 9, thereby adjusting airflow connection between the airflow channels 24 and the launch tubes 6 and 7. In a preferred embodiment the ball shuttle 9 is positioned such that the through hole 15 of the ball-receiving seat 13 is only partially aligned with the respective launch tube. By this the cross-sectional area for the airflow may be continuously changed/adapted from zero to maximum (i.e. where the ball-receiving seat 13 is in registration with the respective launch tube).

To adjust the relevant parameters of airflow, the control system 35 may include an airflow controller 17 which may be responsive to ball speed.

According to an embodiment, the control system 35 may include a calibration and/or self-adaption component, which may calibrate and/or self-adapt the settings of the airflow generator 5 and/or of the ball shuttle 9 and/or of additional airflow components such as valves, so as to achieve a desired ball speed and/or a desired rolling path of the ball 4 in the playing area 10. Such calibration may be effected prior to using the gaming system and/or self-calibration may be effected during gaming operation taking into account the detected parameters such as ball speed of a plurality of gaming rounds or launching processes.

In an embodiment the control system may provide signals to the betting apparatus indicating, or based upon, the timing of the launching of the ball 4 into the roulette wheel 38. The betting apparatus may use these signals to determine when to stop taking new bets on a game of roulette from users. The stopping of taking new bets on a game of roulette is generally referred to as closing the game. A roulette game may be closed after the roulette ball has been launched into the roulette wheel bowl, during the spin cycle.

Each gaming terminal may be provided with a display device which may include a monitor, preferably in terms of a touch screen so as to display information relative to the ball game and/or information relative to placing bets and/or making predictions depending on whether the gaming system is playable with money or free of money.

In an embodiment, a display device may be provided and adapted to display a wagering field, sometimes referred to as the betting layout. Such wagering field may include a template which specifies a grid of numbers and betting options, wherein the numbers in the grid may correspond to the numbers in the pockets of the spinning wheel. Each graphical wagering layout enables a player to select desired numbers and betting combinations for their wagers. For example, a touch screen may allow for identifying a desired amount of credit by means of touching the respective coin symbol and, e.g., in a second step to place such amount of money on a specific number, e.g., by means of touching the respective number in the grid of numbers.

Furthermore, the display device also may be used so as to display further information such as, e.g., the time frame for placing bets which, e.g., may include the invitation "Game over—place your bet".

In addition to such input means, the input device which may be implemented by the aforementioned touch screen, may include start signal input means which may be implemented by a respective display symbol on the aforementioned touch screen. Such start signal input means allows for inputting a start signal at the touch screen of the gaming terminal.

Although a gaming system in terms of a roulette game has been illustrated, the ball launcher may be used in other gaming systems such as table soccer.

What is claimed is:

1. A ball launcher for launching a ball into a playing area, the ball launcher comprising:

an airflow generator;

a first launch tube connected to the airflow generator;

a second launch tube connected to the airflow generator, wherein the second launch tube defines a different launch direction into the playing area than the first launch tube; and a ball gate comprising a ball shuttle having at least one ball-receiving seat configured to receive the ball, the ball shuttle rotatable from a ball-receiving station for receiving the ball in the at least one ball-receiving seat to each of the first or second launch tubes so as to bring the at least one ball-receiving seat into registration with each of the first or second launch tubes.

2. The ball launcher according to claim 1, wherein said ball shuttle comprises a shuttle rotor having the at least one ball-receiving seat and being rotatably supported about a shuttle rotor axis, wherein the at least one ball-receiving seat and openings of said first and second launch tubes are positioned on a circular path around the shuttle rotor axis.

3. The ball launcher according to claim 2, wherein the shuttle rotor axis is a substantially horizontal shuttle rotor axis, and wherein the shuttle rotor is configured to stop with the ball-receiving seat at a ball-receiving station positioned at about 12 o'clock (when considering the shuttle rotor as a clock), and to stop with the ball-receiving seat at about 8 to 11 o'clock to register the ball-receiving seat with the first launch tube, and to stop at about 1 o'clock to 4 o'clock to register the ball-receiving seat with the second launch tube.

4. The ball launcher according to claim 1, wherein the ball shuttle forms a valve configured to open and close each of the first and second launch tubes such that when the first launch tube is open the second launch tube is closed.

5. The ball launcher according to claim 1, wherein the first and second launch tubes extend from opposite sides of the ball shuttle to define launching directions opposite to each other.

6. The ball launcher according to claim 1, wherein at least one of the first and second launch tubes has a non-circular cross-sectional contour.

7. The ball launcher according to claim 6, wherein the cross-sectional contour is elliptical with a main cross-sectional axis extending upright.

8. The ball launcher according to claim 1, wherein the airflow generator is configured to provide for variable airflow speed and is controlled by an airflow controller in communication with at least one ball speed detection device.

9. The ball launcher according to claim 8, wherein the at least one ball speed detection device comprises at least two ball sensors spaced apart from each other.

10. The ball launcher according to claim 8, wherein the airflow controller is configured to cause the airflow generator to generate airflow in a direction opposite to a ball moving direction when a detected ball speed is higher than a desired ball speed.

11. The ball launcher according to claim 8, wherein the airflow controller is configured to control the position of the ball shuttle and the power of the airflow generator in response to a determined ball speed.

12. The ball launcher according to claim 8, wherein the airflow controller includes a calibration component for effecting calibration of airflow in response to a plurality of values of ball speed determined in a plurality of different launching processes.

13. The ball launcher according to claim 1, further comprising a feeding tube for feeding a ball from the playing area to the ball gate, said feeding tube having an inlet positioned directly beneath the playing area, wherein the feeding tube provides for a substantially vertical ball path from the inlet to the ball gate.

14. A roulette gaming system comprising:

a playing area comprising a roulette wheel, wherein at least a portion of the roulette wheel is moveable to form a ball discharge opening; and a ball launcher comprising:

an airflow generator;

a first launch tube connected to the airflow generator;

a second launch tube connected to the airflow generator, wherein the second launch tube defines a different launch direction into the playing area than the first launch tube; and a ball gate comprising a ball shuttle having at least one ball-receiving seat configured to receive the ball, the ball shuttle rotatable from a ball-receiving station for receiving the ball in the at least one ball-receiving seat to each of the first or second launch tubes so as to bring the at least one ball-receiving seat into registration with each of the first or second launch tubes.

15. The roulette gaming system according to claim 14, wherein the ball discharge opening is substantially vertically above a ball gate and is connected with the ball gate via a feeding tube providing for a substantially vertical path from the ball discharge opening to the ball gate.

16. The roulette gaming system according to claim 14, wherein the first and second launch tubes are arranged to have exits extending in substantially opposite directions tangential to a bank path of a roulette bowl.

17. The roulette gaming system according to claim 14, further comprising:

a detection device configured to detect a pocket into which a ball has landed; and a position controller configured, in response to an identification of the pocket into which the ball has landed by the detection device, to move the playing area relative to the ball launcher so that the identified pocket is brought into a position directly above the ball launcher.

18. The roulette gaming system according to claim 14, wherein at least one of the first and second launch tubes has a non-circular cross-sectional contour.

19. The roulette gaming system according to claim 14, wherein the airflow generator is configured to provide for variable airflow speed and is controlled by an airflow controller in communication with at least one ball speed detection device.

20. The roulette gaming system according to claim 19, wherein the airflow controller is configured to cause the airflow generator to generate airflow in a direction opposite to a ball moving direction when a detected ball speed is higher than a desired ball speed.

* * * * *